US005367834A

United States Patent [19]

Delventhal

[11] Patent Number: 5,367,834

[45] Date of Patent: Nov. 29, 1994

[54] EDGE GRINDING APPARATUS

[75] Inventor: Kent A. Delventhal, Genoa, Ohio

[73] Assignee: Progress Design and Machine, Inc., Clyde, Ohio

[21] Appl. No.: 963,376

[22] Filed: Oct. 20, 1992

[51] Int. Cl.[5] ..... B24B 9/00

[52] U.S. Cl. ..... 451/285; 451/281; 451/283; 451/43

[58] Field of Search ..... 51/100 R, , 101 R, 101 LG, 51/283 E, 102, 103 R, 105 R, 105 EC

[56] References Cited

U.S. PATENT DOCUMENTS

| | | | |
|---|---|---|---|
| 2,964,885 | 12/1960 | Jalbert | 51/101 R |
| 3,274,736 | 9/1966 | Brokaw | 51/101 R |
| 4,081,927 | 4/1978 | Kelly | 51/101 R |
| 4,525,958 | 7/1985 | Reissig | 51/101 R |
| 5,009,038 | 4/1991 | Yoshikawa et al. | 51/101 R |

*Primary Examiner*—Bruce M. Kisliuk
*Assistant Examiner*—Eileen P. Morgan
*Attorney, Agent, or Firm*—Willian Brinks Hofer Gilson & Lione

[57] ABSTRACT

An apparatus for successively grinding the edges of a series of like, sheetlike articles, such as glass sheets, and especially irregularly shaped glass articles such as automotive windows. The apparatus includes a frame, a table rotatably secured to the frame, a clamp for clamping an article on the table, and a template of the article carried by the table, but at an elevation below that of the article. The apparatus also has a swing arm assembly which carries a spindle near its outer free end, an inner end of the swing arm assembly being pivotally secured to the frame, the swing arm assembly being movable in a plane to move the spindle toward or away from the table. The spindle of the swing arm assembly has a rotatable grinding wheel which is positioned to engage the edge of an article on the table and a motor drive for rotating the grinding wheel. The spindle further has a cam follower which is positioned to engage the edge of the template when the grinding wheel engages the article. The cam follower has a frustoconical outer, template engaging surface, and is translated with respect to the spindle to compensate for grinding wheel wear by changing the diameter of the portion of the cam follower that engages the template.

14 Claims, 9 Drawing Sheets

EDGE GRINDING APPARATUS

BACKGROUND OF THE INVENTION

This invention relates to apparatus for grinding the edges of like sheetlike articles, such as glass sheets. More particularly, this invention relates to apparatus for grinding the edges of irregularly shaped sheetlike articles to close dimensional specifications on a repetitive basis.

Irregularly shaped planar articles, such as glass articles, are often subjected to an edge grinding operation to impart a suitable surface texture to the edge of the article and to bring the article to its final dimensional specifications. Apparatus for performing such an edge grinding operation is usually designed to be able to process irregularly shaped articles for maximum flexibility in a manufacturing operation. In such apparatus, a rotatable grinding wheel is caused to rotate about its central axis as the article being processed is rotated about its axis to permit the grinding wheel to successively engage all portions of the periphery of the article. The grinding wheel is maintained in engagement within the article by the engagement of a cam follower portion of the grinding apparatus with a precisely machined template in the desired configuration of the article being processed.

Compensation for normal wear of an edge grinding wheel during a production run can be obtained by using a cam follower with a tapered or frustoconical external configuration to follow the outline of the template, and by gradually translating the cam follower with respect to the template along the central axis of the cam follower from its larger diameter toward its smaller diameter during the production run. Such an advancement of a tapered cam follower makes it possible to maintain a constant grinding wheel position at the grinding location, notwithstanding a reduction in the diameter of the grinding wheel as a result of wear.

Heretofore, the use of a tapered, axially translatable cam follower usually required that the spindle containing the cam follower be mounted on a sliding bracket separate from the spindle used to rotatably support the grinding wheel. However, such sliding arrangements can gradually lead to wear on the elements thereof, and this, in turn, can undesirably affect the position of the grinding wheel.

Further, in apparatus of the type described above, the grinding wheel and the cam follower of prior art edge grinding devices have been mounted on opposite sides of the sheet being processed, on separate spindles with separate axes which are intended to be coaxial. However, in a long production run, these axes are subject to becoming misaligned, with another source of dimensional error in the articles being processed.

SUMMARY OF THE INVENTION

According to the present invention there is provided apparatus for repetitively grinding the edges of like planar articles. Such apparatus is self-compensating for wear during a production run. Such apparatus uses a tapered cam follower to follow the outline of a template of the article being processed, and the cam follower and the grinding wheel are positioned coaxially on a common spindle on the same side of the article being processed to ensure that no axial misalignment therebetween can occur during a production run as a result of wear of the various elements of the apparatus. Apparatus of the foregoing character is especially useful in forming proper edges on like, irregularly shaped planar glass articles, such as windows for automobiles.

Accordingly, it is an object of the present invention to provide improved apparatus for repetitively grinding the edges of like, irregularly shaped planar articles. More particularly, it is an object of the present invention to provide improved apparatus of the foregoing character which is self-compensating for wear during a production run, and which is capable of forming edges to close dimensional specifications throughout a production run.

For a further understanding of the present invention and the objects thereof, attention is directed to the drawing and the following brief description thereof, to the detailed description of the preferred embodiment of the invention and to the appended claims.

DETAILED DESCRIPTION OF THE PREFERRED EMBODIMENT

Figure 1:
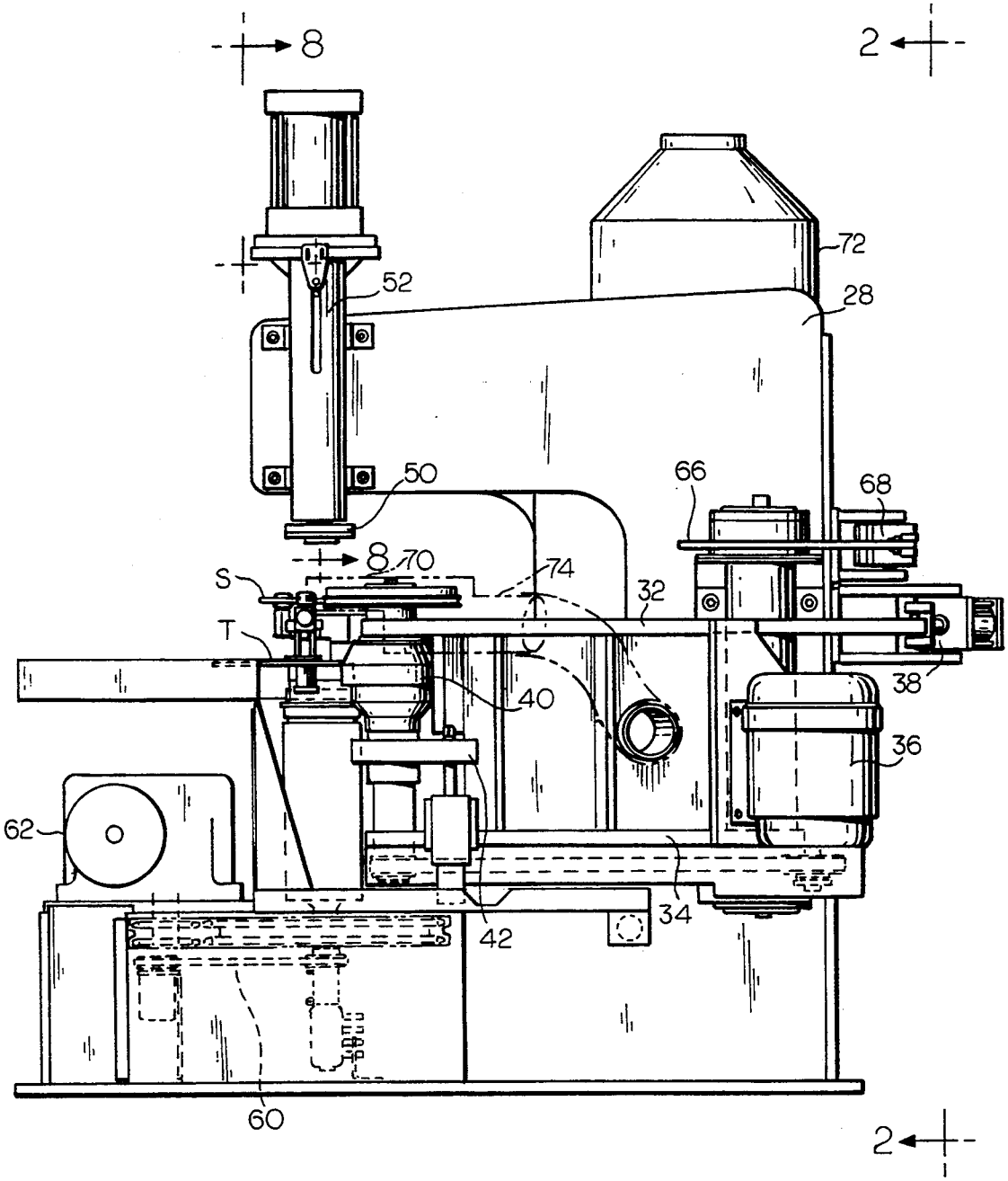
FIG. 1 is a side elevational view of edge grinding apparatus according to a preferred embodiment of the present invention, portions of such apparatus being illustrated only in other drawing figures to avoid undue complexity in FIG. 1.
Figure 2:
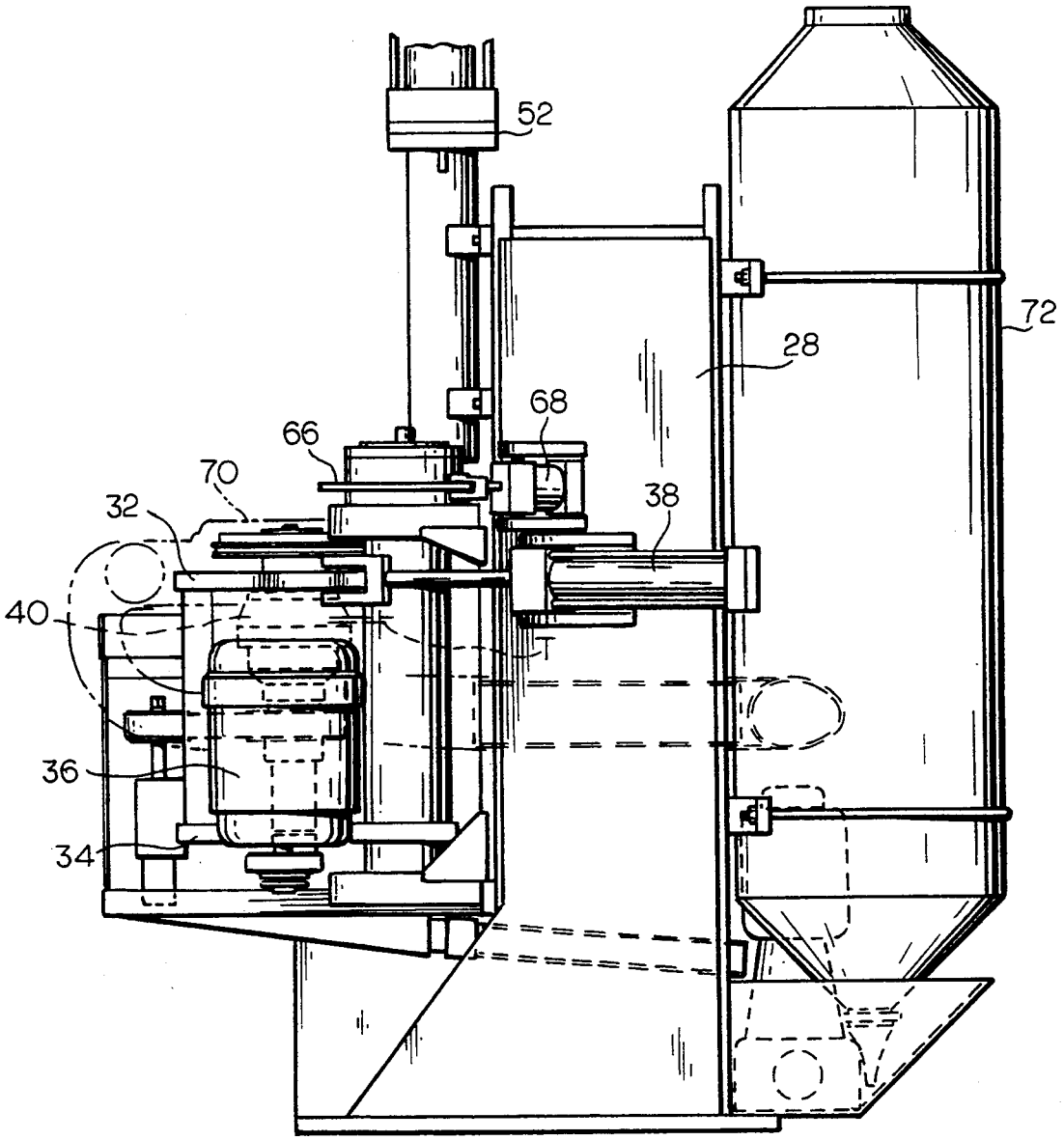
FIG. 2 is an elevational view of the edge grinding apparatus of FIG. 1, taken on line 2—2 thereof.

As is shown in FIG. 1 and various other drawing figures, a generally planar article S to be subjected to an edge grinding operation in an endless pattern around its periphery is positioned generally horizontally in an edge grinding apparatus, generally indicated by reference numeral 10. The article S, which may be irregularly shaped, is releasably clamped to a rotatable table 12 by a plurality of spaced apart, individually retractable, edge engaging elements 14, 16, 18, 20, 22, which are mounted at the free ends of the piston rods of pneumatic cylinders, such as the cylinders 24, 26 for the contact elements 18, 20, respectively. The contact elements 14, 16, 18, 20, 22 are individually and sequentially retracted in translation and partial rotation as the table 12 rotates to provide unimpeded engagement of the edge of the article S by a rotatable edge grinding wheel 30 as the table 12 and the sheet S rotate in unison with respect to the grinding wheel 30. The rotation of the table 12 is powered by a drive unit, generally indicated in dotted line by the reference numeral 60 in FIG. 1, whose speed of rotation can be adjusted by means of a variable speed drive unit 62.

Figure 3:
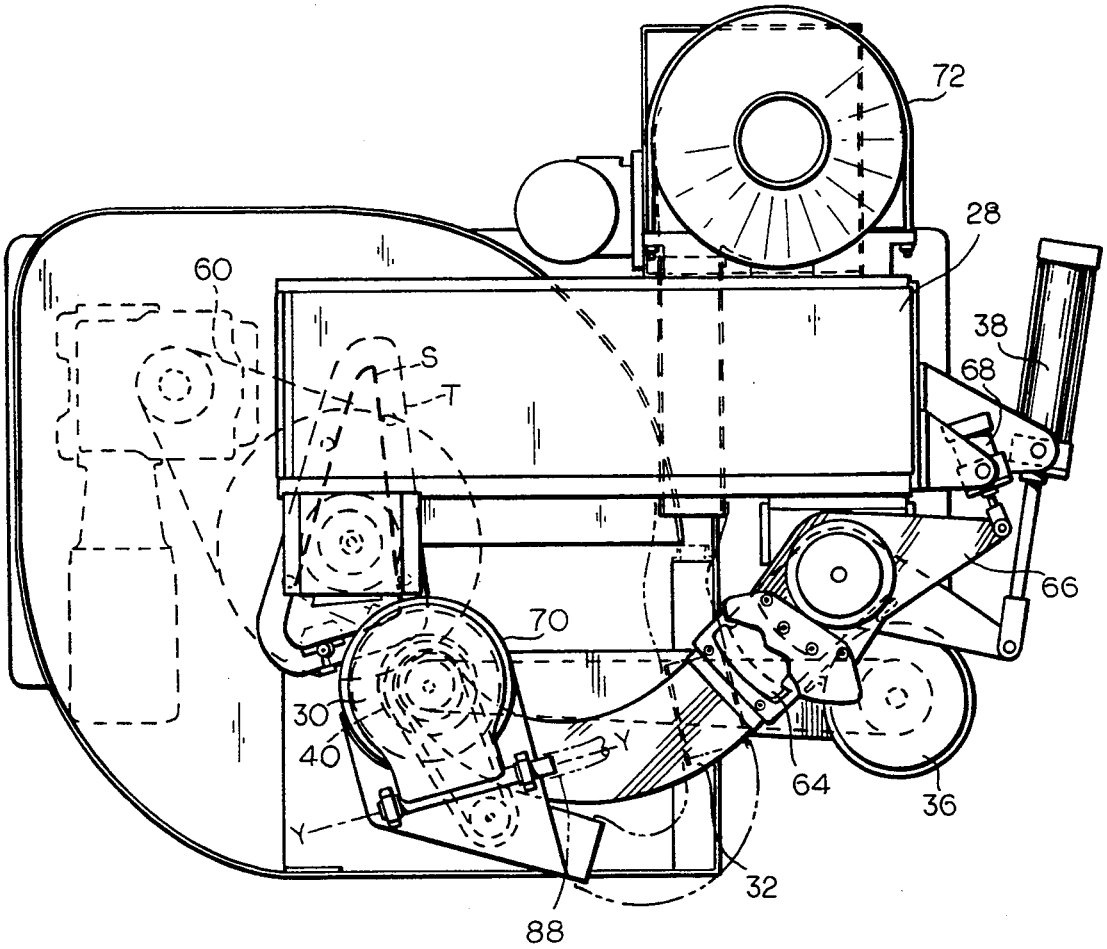
FIG. 3 is a plan view of the apparatus of FIGS. 1 and 2, certain elements of such apparatus which are hidden from view by other elements thereof being indicated by a broken line.
Figure 9:
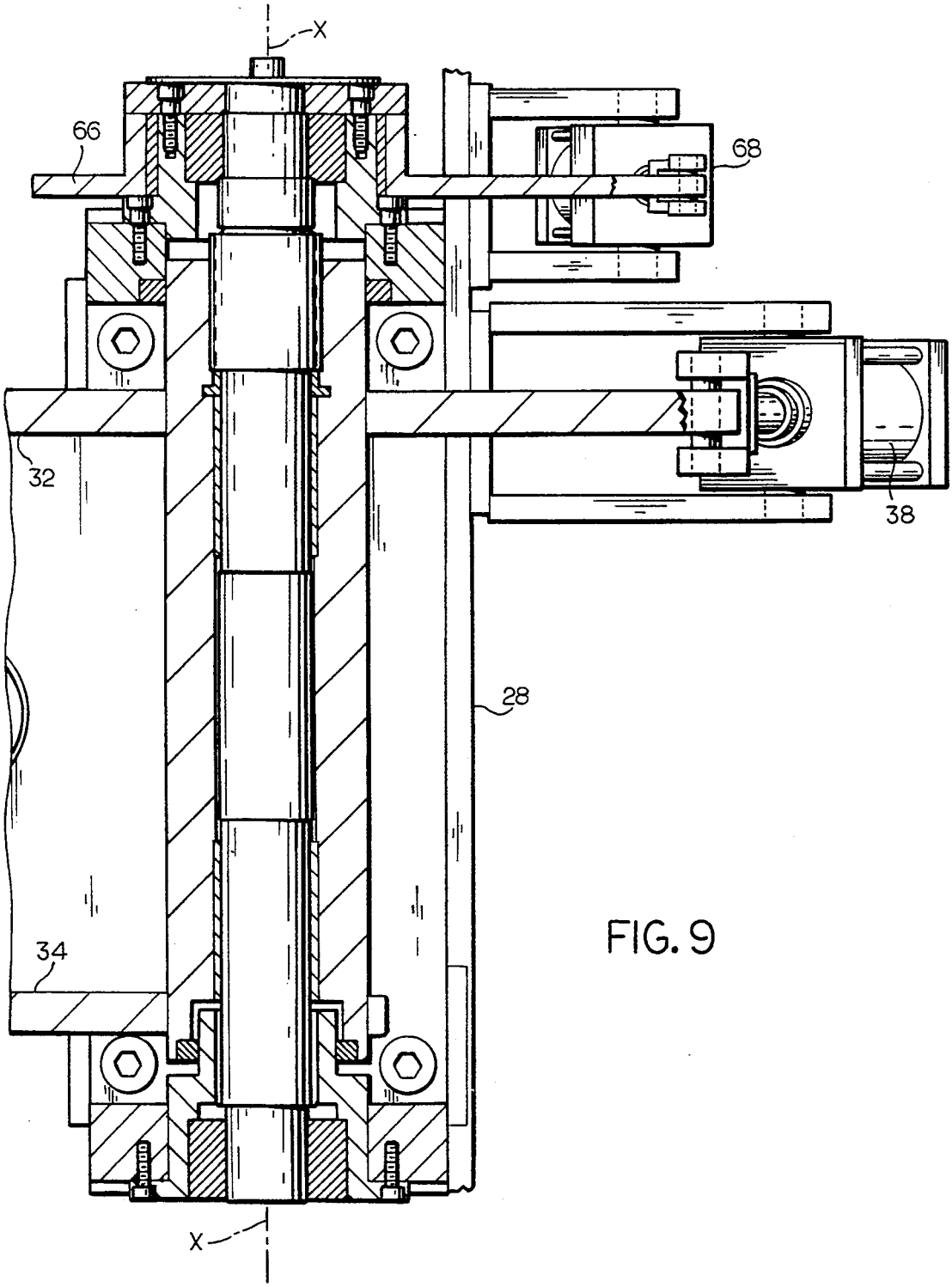
FIG. 9 is a fragmentary elevational view, party in cross-section, of a portion of the apparatus of FIGS. 1–8.

The grinding wheel 30 is rotatably mounted on a spindle 42 which is carried by an upper swing arm 32 and a lower swing arm 34, near the free ends thereof. The arms 32, 34 are preferably formed in a common weldment with a vertical member 76 that extends therebetween. The swing arms 32, 34 are pivotally attached to a frame 28 of the grinding apparatus 10 and swing in unison with respect to the frame 28 about an axis X—X, FIG. 9, in a plane extending parallel to the plane of the sheet S, preferably a horizontal plane. Thus, the swinging of the arms 32, 34 is effective to bring the grinding wheel 30 into engagement with the edge of the sheet S. The grinding wheel 30 is caused to rotate about its vertical central axis, which is also the vertical central axis of the spindle 42, by a drive motor 36. The drive motor 36 is attached to the swing arms 32 and 34 to swing therewith and transmits torque to a pulley or sheave, not shown, on the axis of the spindle 42 by a conventional belt or chain drive. The upper swing arm 32 and the lower swing arm 34 are moved in unison in an arc to move the grinding wheel 30 toward the sheet S by advancing the piston rod of a double acting hydraulic cylinder 68. An inner portion of the cylinder 68 is pivotally attached to the frame 28 and an outer piston rod portion of the cylinder 38 is pivotally attached to an arm 66 which is releasably clamped to an inner portion of the swing arm 32 by a disc brake 64, as shown in FIG. 3. The swing arms 32 and 34 are maintained in engagement with an article S by a load imposed on an inner portion of the swing arm 32 by a single acting pneumatic cylinder 38. The piston rod of the cylinder 68 is then retracted at the conclusion of a grinding cycle, after reducing the pressure in the cylinder 38, to retract the grinding wheel 30 from the article S and thereby permit the removal of a processed article S and its replacement by another like article to be processed.

A tapered or frustoconical cam follower 40 is freely rotatably mounted on the spindle 42 coaxially with the grinding wheel 30, at the free ends of the swing arms 32, 34. Thus, the cam follower 40 pivots with the grinding wheel 30 as the grinding wheel 30 moves toward and away from an article S. Travel of the grinding wheel 30 toward the article S is limited by the travel of the cam follower 40 into engagement with a template T. The template T is affixed to the rotating table 12 to rotate with the article S and is in the configuration of the article S. However, the template T is somewhat larger than the article S, to permit the diameter of the cam follower 40 to be smaller than that of the grinding wheel 30, to thereby permit the apparatus 10 to be used in the processing of small articles.

Figure 8:
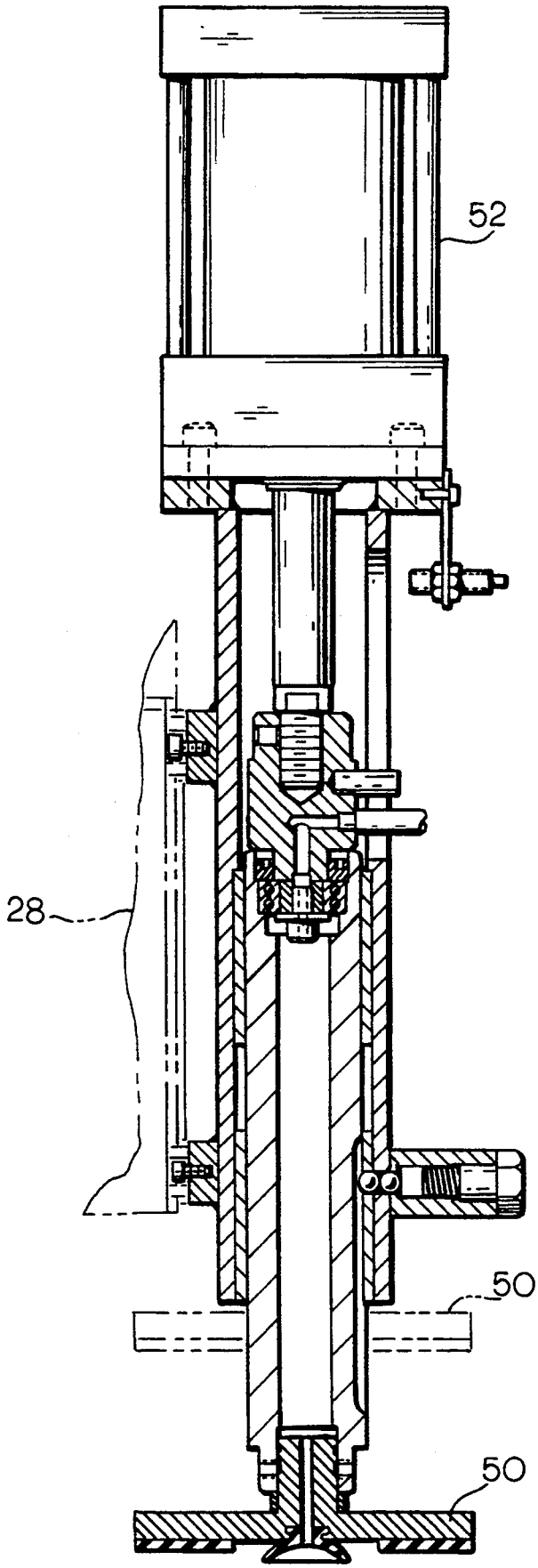
FIG. 8 is a sectional view taken on line 8—8 of FIG. 1.

The placement of an article S on the table 12, and the eventual removal of the article S from the table 12, is accomplished by means of a clamp 50 which is at the free end of the piston rod of a hydraulic or pneumatic cylinder 52. The cylinder 52, in turn, is secured to the frame 28. An article S may be precisely oriented on the table 12 by hand or robotically, in accordance with known technology. The clamp 50 is movable between the positions illustrated, respectively, in solid line and dotted line in FIG. 8 to securely retain the article S in position during its grinding cycle and then to permit it to be released to permit its replacement with a fresh article for the next grinding cycle.

Figure 7:
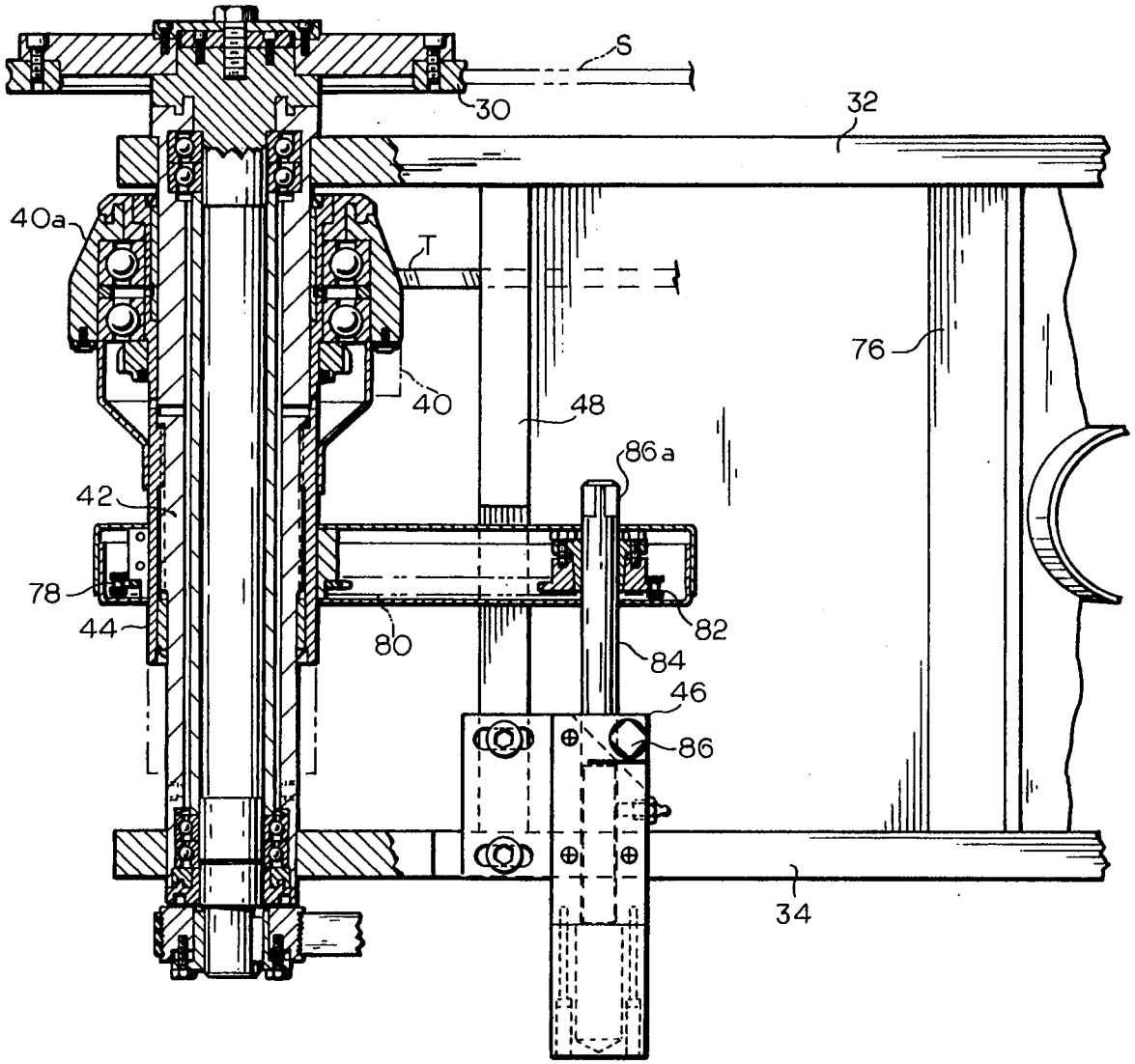
FIG. 7 is a fragmentary elevational view, partly in cross-section, of a portion of the apparatus of FIGS. 1–6.

During a production run of a multitude of like articles S, the article edge engaging surface of the grinding wheel 30 will gradually diminish in diameter as a result of grinding wheel wear. However, in the preferred embodiment of the present invention, this grinding wheel wear is prevented from leading to dimensional variations in the processed article S by constructing the cam follower with a tapered or frustoconical template engaging surface, FIG. 7, and by positioning the cam follower 40 on a vertically adjustable sleeve 44 which is mounted coaxially on the spindle 42 and which is capable of limited vertical movement with respect thereto. Preferably, and as illustrated, the sleeve 44 is threadably attached to the spindle 42 and is translated with respect to the spindle by the rotation of a sprocket 78 which is driven by an endless roller chain 80. The roller chain 80, in turn, is also trained around a sprocket 82 that is keyed to a vertical rod which is adjustably supported in a vertical bracket 46.

Thus, the cam follower 40 can be, and is, caused to vertically translate relative to the template T such that the template T gradually contacts an ever reducing diameter portion of the cam follower 40 as the grinding wheel 30 is reduced by wear. During a production run, the adjustable sleeve 44 is caused to gradually move downwardly in its orientation depicted in FIG. 7, that is, to gradually reduce the diameter of the portion that is contacted by the template T, to thereby move the center line of the grinding wheel 30 closer and closer toward the location of an article S on the table 12. The translation of the cam follower 40 and the sleeve 44 by the rotation of the vertical rod 84, as heretofore described, can be automatically controlled in response to an indication of grinding wheel wear, it can be done automatically based on a counter that counts the number of articles processed during a production run, or it can be done manually based on dimensional measurements of processed articles S from time to time during a production run. The bracket 46 is fixedly positioned with respect to the swing arms 32, 34 by attaching it to a bar 48 which extends between the swing arms 32, 34 and which is a further element of the weldment that includes such swing arms. The vertical rod 84 is releasably clamped in a fixed but adjustable position with respect to the bracket 46 by a tightening bolt 86, and the vertical rod 84 is provided with a tool engageable outer free end 86a to permit it to be manually turned to adjust the elevation of the cam 40.

The grinding of an article S of a glass material is beneficially performed with the assistance of a cooling spray. To that end, a spray hood 70, which is positioned above the location of the grinding wheel 30 and which is pivotable in a vertical plane about an axis Y—Y to change diamond wheels for easy access, FIGS. 3 and 4, as it swings with the swing arms 32, 34, is also preferably provided and fitted with internal spray nozzles, not shown, which receive a suitable coolant through an inlet line 88. When a spray hood 70 is used, as described, the spent cooling liquid will be preferably removed through the spray hood 70, and returned to a spray type cleaning chamber 72, which is operated under partial vacuum, through a conduit 74. The grinding of an article S of a glass material, as well as the grinding of articles of other materials, normally releases dust and debris at the grinding site. Such dust and debris is objectionable for environmental and worker safety reasons if not properly collected and disposed of. Accordingly, the grinding apparatus 10 is preferably fitted with a debris collecting pan 90 at the grinding site, below the location of the grinding wheel 30, as indicated in outline in FIG.

Figure 4:
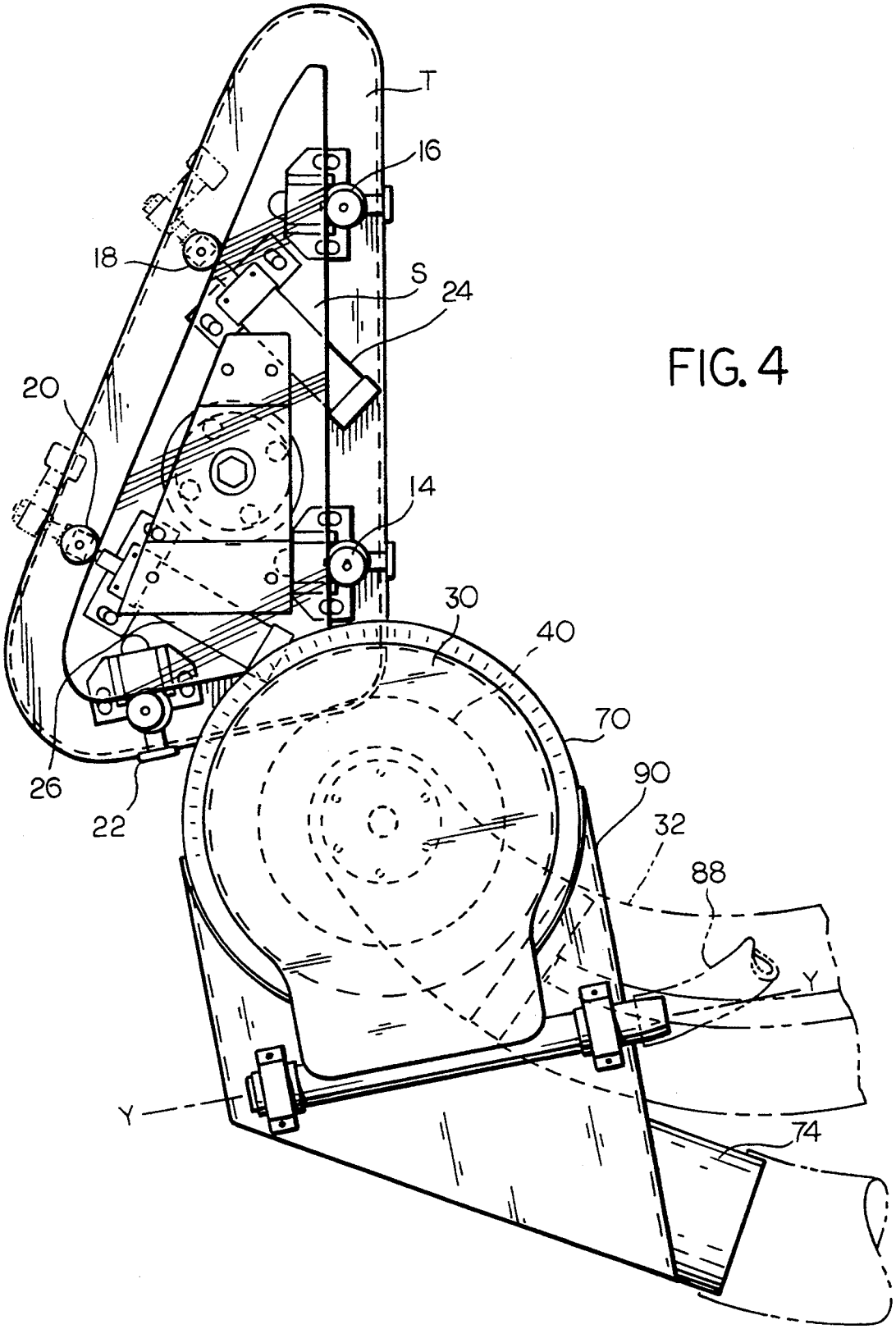
FIG. 4 is a plan view of a portion of the apparatus of FIGS. 1–3 at a somewhat larger scale.
Figure 5:
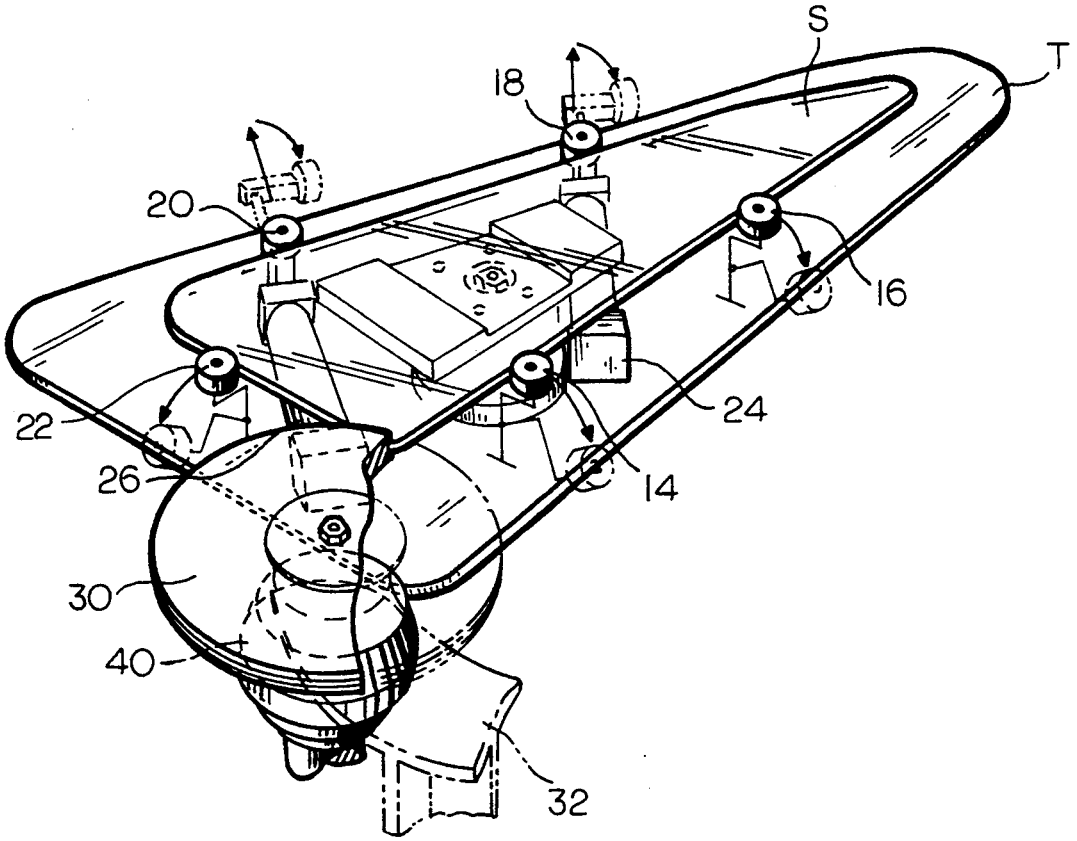
FIG. 5 is a perspective view of a portion of the apparatus of FIGS. 1–4.
Figure 6:
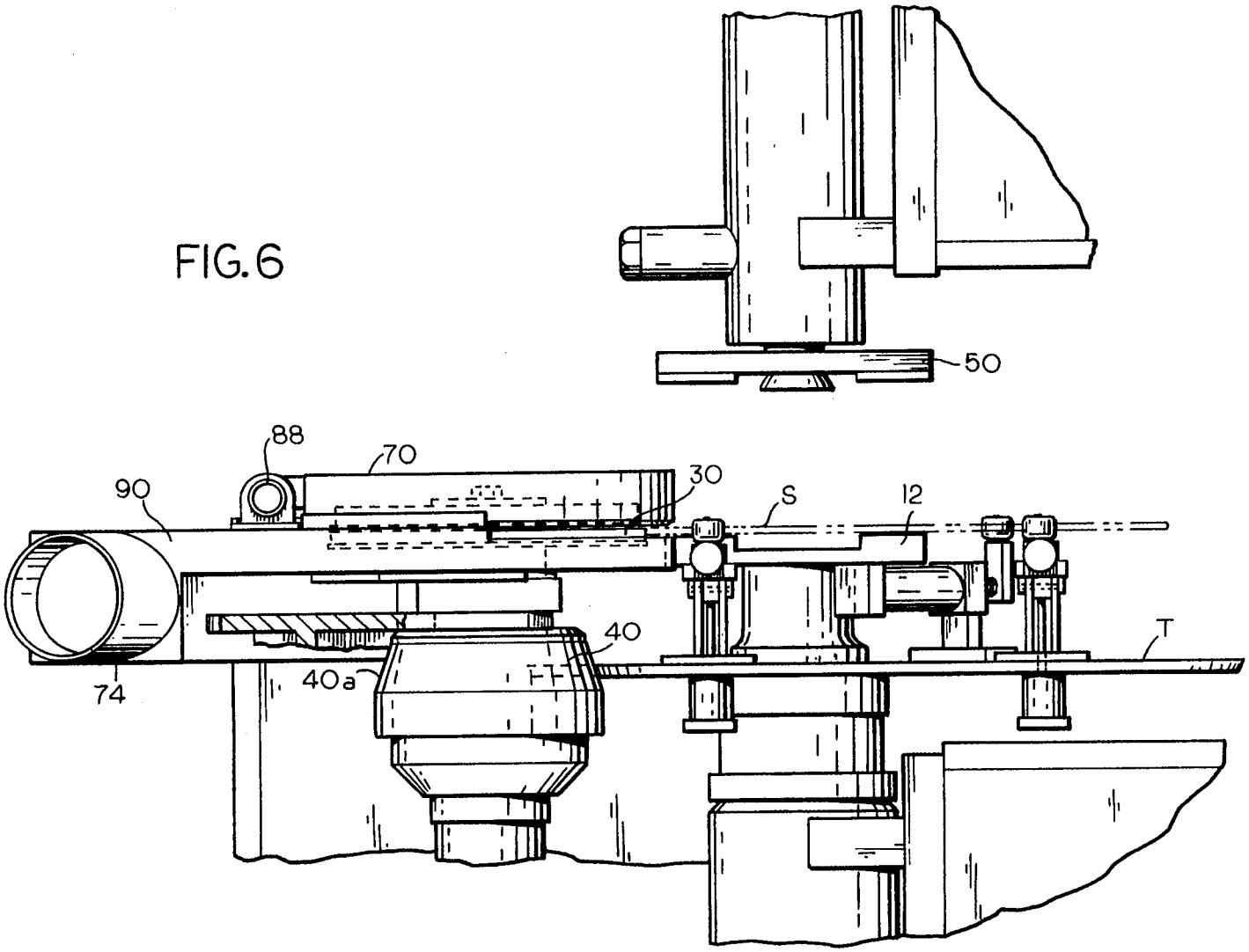
FIG. 6 is a fragmentary elevational view of a portion of the apparatus of FIGS. 1–5.

1 and in solid line in FIGS. 3, 4 and 6. The pan 90 is connected to a sump 72*a* of the spray type cleaning chamber 72.

Although the best mode contemplated by the inventor for carrying out the present invention as of the filing date hereof has been shown and described herein, it will be apparent to those skilled in the art that suitable modifications, variations and equivalents may be made without departing from the scope of the invention, such scope being limited solely by the terms of the following claims and the legal equivalents thereof.

What is claimed is:

1. An apparatus for performing an edge grinding operation on a generally flat, sheetlike article, said apparatus comprising:

a frame;

a table for supporting an article, said table being rotatably secured to said frame for rotation about an axis extending generally perpendicularly to an article on said table;

means for rotating said table;

means for releasably securing an article on said table for rotation therewith;

arm means having an inner end and an outer end, said inner end being pivotally secured to the frame;

a spindle carried by said arm means near the outer end thereof;

rotatable grinding wheel means carried by said spindle;

means for rotating said grinding wheel means about a central axis of rotation;

means for biasing said arm means to urge said grinding wheel means into engagement with the edge of an article on said table;

a template carried by said table, said template having an outline corresponding to the outline of an article on said table;

a cam follower mounted on said spindle, said cam follower being positioned and sized to engage the template when said grinding wheel means is in engagement with an edge of the article; and second arm means having an inner end pivotally secured to said frame, and brake means releasably coupling said arm means and said second arm means for pivotal movement in unison with respect to said frame.

2. Apparatus according to claim 1 wherein said table is rotatable about a generally vertical axis, and wherein said grinding wheel means and said cam follower are positioned on the same side of an article on said table.

3. Apparatus according to claim 2 wherein the same side of an article on said table is the underside of the article.

4. Apparatus according to claim 1 wherein said cam follower is translatable along the central axis of rotation of said grinding wheel means, and wherein said cam follower has a generally frustoconical, template engaging surface, and further comprising:

means for translating said cam follower along the central axis of rotation of said grinding wheel means to move the contact location between said template and said cam follower from a larger diameter location of said cam follower to a smaller diameter portion of said cam follower, to thereby maintain said grinding wheel means in engagement with edges of successive like articles during a production run of like articles, notwithstanding wear of said grinding wheel means during the production run.

5. Apparatus according to claim 1 wherein said cam follower is freely rotatable with respect to said spindle.

6. Apparatus according to claim 1 wherein said means for rotating said grinding wheel means is carried by said arm means at a location near said outer end thereof.

7. Apparatus according to claim 3 wherein the article is formed from glass and wherein said arm means further comprises:

spray means positioned above the location of an article on said table for directing a cooling spray toward an article on the table.

8. Apparatus according to claim 7 wherein said spray means is pivotable about a horizontal axis with respect to said arm means.

9. Apparatus according to claim 1 wherein said means for releasably securing an article on said table for rotation therewith comprises:

clamping means, said clamping means being translatable along an axis extending generally perpendicularly to an article on said table into and out of engagement with an article on said table; and means for translating said clamping means with respect to an article on said table.

10. Apparatus according to claim 1 wherein said template is substantially larger, in its outline, than the article, and wherein said cam follower is substantially smaller, in a direction extending transversely of the central axis of rotation of said grinding wheel means, than said grinding wheel means.

11. An apparatus for performing an edge grinding operation on a generally flat, sheetlike article, said apparatus comprising:

a frame;

a table for supporting an article, said table being rotatably secured to said frame for rotation about an axis extending generally perpendicularly to an article said table;

means for rotating said table;

means for releasably securing an article on said table for rotation therewith;

arm means having an inner end and an said inner end being pivotally secured to the frame;

a spindle carried by said arm means near an outer end thereof;

rotatable grinding wheel means carried by said spindle;

means for rotating said grinding wheel means about a central axis of rotation;

means for biasing said arm means to urge said grinding wheel means into engagement with the edge of an article on said table;

a template carried by said table, said template having an outline corresponding to the outline of an article on said table; and a cam follower mounted on said spindle,said cam follower being positioned and sized to engage the template when said grinding wheel means is in engagement with an edge of the article;

wherein said means for releasably securing an article on said table for rotation therewith comprises:

clamping means, said clamping means being translatable along an axis extending generally perpendicularly to an article on said table into and out of engagement with an article on said table;

means for translating said clamping means with respect to an article on said table; and a plurality of article edge engaging elements spaced apart around an article on said table, each edge engaging element being retractable from the article as said table rotates to permit said rotatable grinding wheel means to engage all portions of the edge of an article on said table.

12. Apparatus according to claim 11 wherein said second cylinder is a single acting, pneumatic cylinder.

13. An apparatus for performing an edge grinding operation on a generally flat, sheetlike articles, said apparatus comprising:

a frame;

a table for supporting an article, said table being rotatably secured to said frame for rotation about an axis extending generally perpendicularly to an article on said table;

means for rotating said table;

means for releasably securing an article on said table for rotation therewith;

arm means having an inner end and an outer end, said inner end being pivotally secured to the frame;

a spindle carried by said arm means near an outer end thereof;

rotatable grinding wheel means carried by said spindle;

means for rotating said grinding wheel means about a central axis of rotation;

means for biasing said arm means to urge said grinding wheel means into engagement with the edge of an article on said table;

a template carried by said table, said template having an outline corresponding to the outline of an article on said table;

a cam follower mounted on said spindle, said cam follower being positioned and sized to engage the template when said grinding wheel means is in engagement with an edge of the article; and second arm means having an inner end pivotally secured to said frame, and brake means releasably coupling said arm means and said second arm for pivotal movement in unison with respect to said frame;

wherein said means for biasing said arm means comprises a double acting hydraulic cylinder having a first end pivotally secured to said frame and a second end pivotally secured to said second arm means, and further comprising:

a second cylinder having a first end pivotally secured to said frame and a second end pivotally secured to said arm means.

14. An apparatus for performing an edge grinding operation on a generally flat, sheetlike article, said apparatus comprising;

a frame;

a table for supporting an article, said table being rotatably secured to said frame for rotation about an axis extending generally perpendicularly to an article on said table;

means for rotating said table;

means for releasably securing an article on said table for rotation therewith;

arm means having an inner end and an outer end, said inner end being pivotally secured to the frame;

a spindle carried by said arm means near the outer end thereof;

rotatable grinding wheel means carried by said spindle;

means for rotating said grinding wheel means about a central axis of rotation;

means for biasing said arm means to urge said grinding wheel means into engagement with the edge of an article on said table;

a template carried by said table, said template having an outline corresponding to the outline of an article on said table; and a cam follower mounted on said spindle, said cam follower being positioned and sized to engage the template when said grinding wheel means is in engagement with an edge of the article;

a first arm having an inner end and an outer end, said inner end of said first arm being pivotally secured to the frame;

a second arm having an inner end and an outer end, said inner end of said second arm being pivotally secured to the frame, said second arm spaced from said firm arm; and means extending between and joining said first arm and said second arm for ensuring that said first arm and said second arm pivot in unison with respect to said frame.

* * * * *